US006076304A

United States Patent [19]

Carrier

[11] Patent Number: 6,076,304

[45] Date of Patent: Jun. 20, 2000

[54] WINDOW OPENING AND CLOSING ASSEMBLY

[76] Inventor: Germain Carrier, 132, Boul. Léon-Vachon (Parc Industriel), Saint-Lambert, Québec, Canada, G0S 2W0

[21] Appl. No.: 09/288,710

[22] Filed: Apr. 9, 1999

[51] Int. Cl.[7] ..... E05F 11/24

[52] U.S. Cl. ..... 49/342; 49/336; 49/362; 74/89.17

[58] Field of Search ..... 49/324, 326, 336, 49/341, 342, 354, 360, 361, 362, 338; 74/89.17, 89.18, 89.19, 89.16

[56] References Cited

U.S. PATENT DOCUMENTS

| | | | |
|---|---|---|---|
| 2,505,912 | 5/1950 | Reynaud | 49/324 |
| 3,103,351 | 9/1963 | Ahlgren | 49/339 |
| 3,152,368 | 10/1964 | Stuart | 49/362 |
| 4,945,679 | 8/1990 | Aumercier | 49/341 |
| 5,715,631 | 2/1998 | Kailian et al. | 49/450 |
| 5,937,582 | 8/1999 | Taylor | 49/341 |

*Primary Examiner*—Daniel P. Stodola
*Assistant Examiner*—Hugh B. Thompson
*Attorney, Agent, or Firm*—Eric Fincham

[57] ABSTRACT

A window opening and closing assembly formed of molded plastic components which includes first and second housing members suitably secured together with a rack slidably mounted in the housing, the rack being moveable between first and second positions which correspond to fully open and fully closed positions for the window, the rack having a tongue extending exteriorly of the housing and designed to engage window rollers, a pinon operatively engaged with the slidable rack, and a handle having a shaft connected to the pinion whereby rotatable movement of the shaft will cause the pinion to move the rack within the housing. There are preferably provided locking members means for locking the handle in at least filly open and fully closed positions. The assembly is easily manufactured and assembled.

11 Claims, 4 Drawing Sheets

WINDOW OPENING AND CLOSING ASSEMBLY

FIELD OF THE INVENTION

The present invention relates to a window opening and closing assembly. More particularly, it relates to a device suitable for opening and closing side opening windows.

BACKGROUND OF THE INVENTION

Originally, most windows utilized in residential applications were of the guillotine type wherein there is provided either a fixed upper window portion and a moveable lower window portion or alternatively where both upper and lower window portions are moveable. Generally, the lower window portions are lifted and retained in a desired lifted position by means of friction or, on occasion, a retaining member was inserted below the open window to maintain it at the desire height. Subsequently side opening crank type windows became popular and many suitable mechanisms were developed for opening and closing the windows. Although there are several variations, most of the devices comprise a crank operated handle which operates to move an arm outwardly, which arm has a distal end thereof seated within a channel on the window. While there are many variations of this particular arrangement, most of them are relatively minor and the system is widely used and is an accepted standard in the industry. Most of these components are formed of a metallic material and must be assembled together.

It is an object of the present invention to provide a window opening and closing assembly which is easy to manufacture and relatively inexpensive.

It is a further object of the present invention to provide a window opening and closing assembly which may be formed of molded plastic materials and easily assembled together.

According to one aspect of the present invention there is a window opening and closing assembly comprising a housing, a rack slidably mounted in the housing, the rack being moveable between first and second positions, the rack having a tongue extending exteriorly of the housing, a pinion operatively engaged with the d slidable rack, and a handle having a shaft connected to the pinion whereby rotatable movement of the shaft will cause the pinion to move the rack within the housing.

In a further aspect of the present invention, there is provided, in combination, a window opening and closing assembly comprising a housing, a rack slidably mounted in the housing, the rack being moveable between first and second positions, the rack having a tongue extending exteriorly of the housing, a pinon operatively engaged with the slidable rack, and a handle having a shaft connected to the pinon whereby rotatable movement of the shaft will cause the pinon to move the rack within said housing.

The window opening and closing assembly of the present invention is preferably formed of a suitable plastic material and in particular, all the components made thereof may be of a molded plastic material. The various components may be connected together by suitable means such as press fitting whereby there is a minimum of fabrication and assembly.

In one embodiment, the housing is formed of first and second housing members suitably secured together. To this end there maybe provided locking pins on one of the housing members which engage suitable recesses on the other of the housing members to frictionally engage the two together.

The rack, as aforementioned, is slidably mounted in the housing and is moveable between first and second positions which correspond to fully closed or open positions of the window. To provide for movement of the rack, the rack may have flanges extending outwardly therefrom which are engageable in grooves formed within the housing members. The ends of the grooves would again define the fully open and closed position of the window.

There is preferably provided means for locking the handle in at least the fully open and fully closed positions. In one embodiment, there may be provided detents or notches in the handle shaft and which notches or detents are engageable by a spring member having a protrusion extending therefrom. Naturally, there may be provided a plurality of notches or detents to hold the window in one or more intermediate positions if so desired.

In a further embodiment, the handle member itself is provided with a resiliently biased clip which is designed to engage and undercut in the housing in both the open and closed positions.

BRIEF DESCRIPTION OF THE DRAWINGS

Having thus generally described the invention, reference will be made to the accompanying drawing embodiments thereof, in which.

SUMMARY OF THE INVENTION

Figure 1:
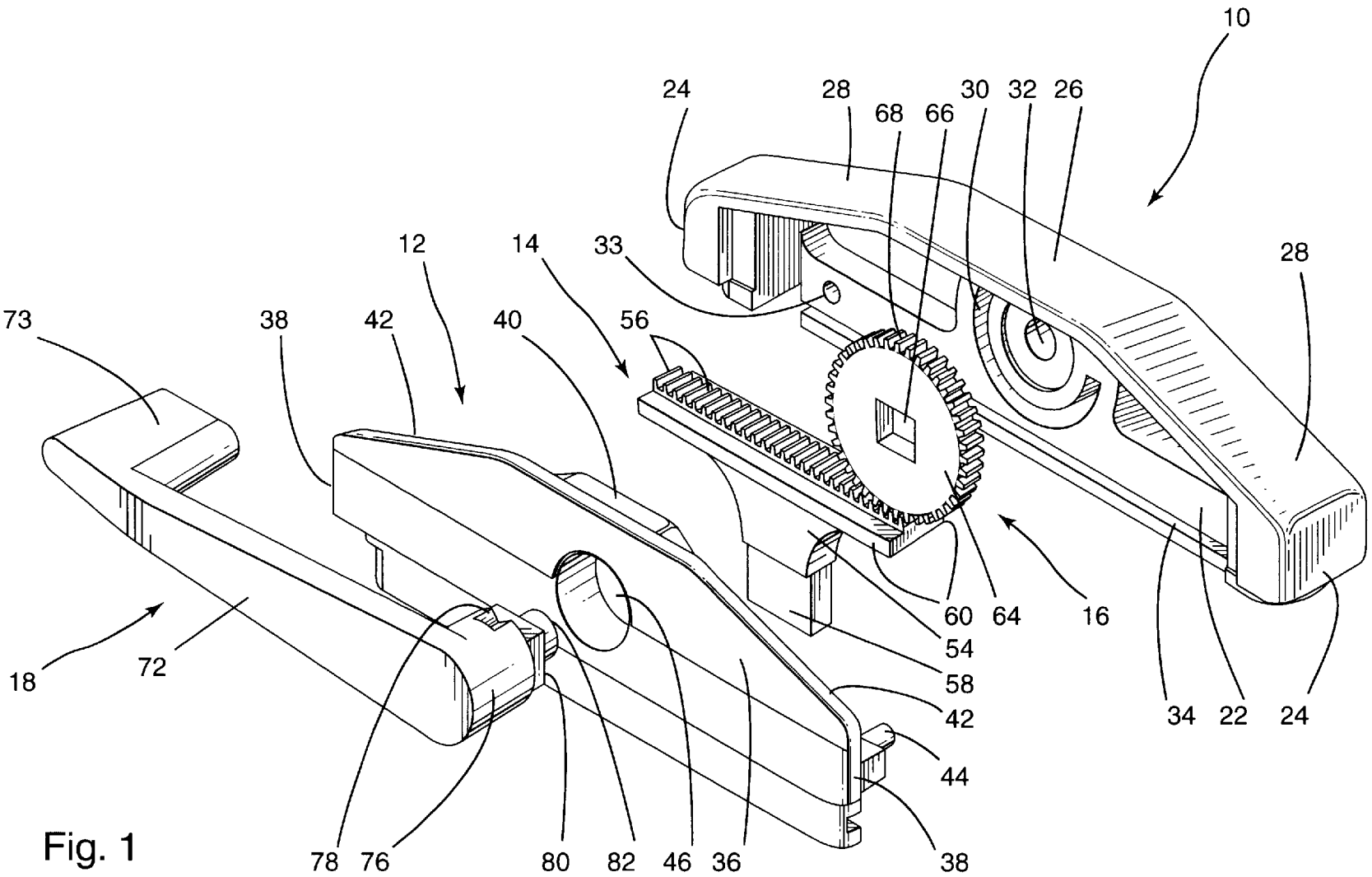
FIG. 1 is a perspective exploded view of one embodiment of a window opening and closing assembly, according to the present invention.
Figure 2:
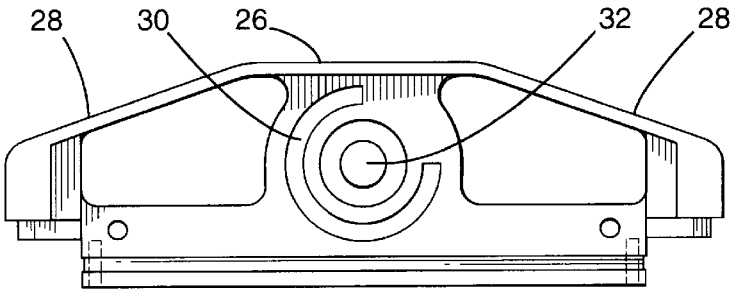
FIG. 2 is a from elevational view of one of the housing members of the assembly of FIG. 1.
Figure 3:
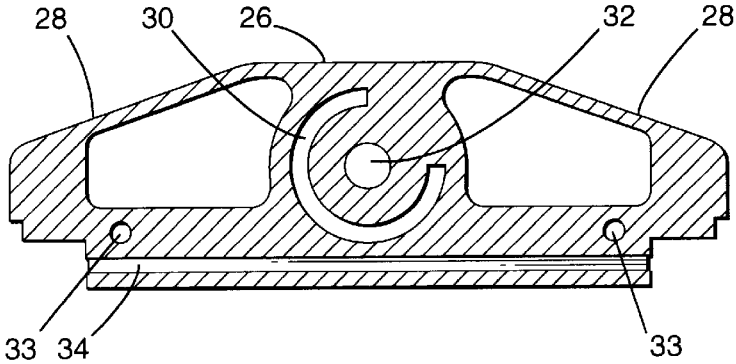
FIG. 3 is a longitudinal sectional view of the housing member of FIG. 2.

Referring to the drawings in greater detail and by reference characters thereto, there is illustrated in FIG. 1 a window opening and closing assembly or device and which is comprised of a first half housing member 10, a second half housing member 12, a slidable rack 14, a pinon 16, and a handle 18.

First half housing member 10 has a back wall 22 and a pair of end walls 24 at either end thereof. There is also provided a top wall which is comprised of a top wall segment 26 and a pair of top sloping wall segments 28.

Formed on the interior surface of back wall 2 is a recess 30 which extends through approximately 270 degrees of a circular configuration. Located interiorly of recess 30 is a center spherical aperture 32 which extends through back wall 22.

Also formed on the interior surface of back wall 22 are a pair of circular recesses 33 and a longitudinally extending slot recess generally designated by reference numeral 34.

Figure 4:
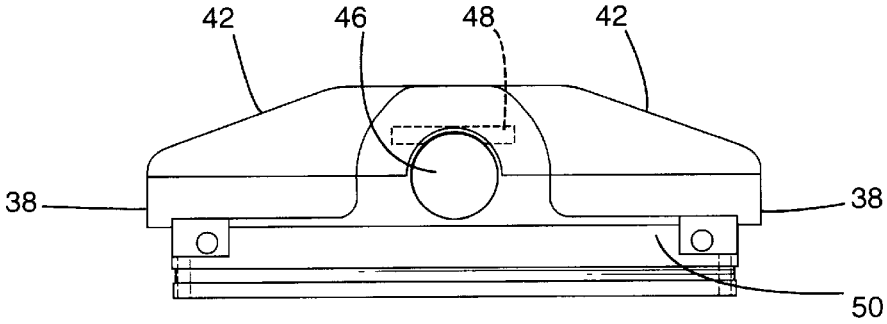
FIG. 4 is an elevational view of the second housing member of the window opening and closing assembly of FIG. 1.

Second half housing member 12, as may be seen in FIGS. 1 and 4 is comprised of a front wall 36 and a pair of end walls 38 at either end thereof. In a manner similar to first half housing 10, the top wall is comprised of a top wall segment 40 and a pair of top sloping wall segments 42.

Extending outwardly from the inner wall of front wall 36 are a pair of locking pins 44. Front wall 36 includes an aperture 46 located centrally therein. Also provided on the inner wall surface of front wall 36 is a lower slot recess 50 and an upper slot recess 48 for reasons which will become apparent hereinbelow.

Slidable rack 14, as may be seen in FIG. 1, has a main body portion 54 and an upper surface on which there are formed a plurality of teeth 56. A pair of flanges 60 extend outwardly from either side while a tongue 58 extends downwardly from he main body 54.

Pinion 16 has a disk shaped body 54 in which there is provided a centrally located square aperture 66. Body 64 has a plurality of teeth 68 formed on the circumferential surface thereof.

Figure 5:
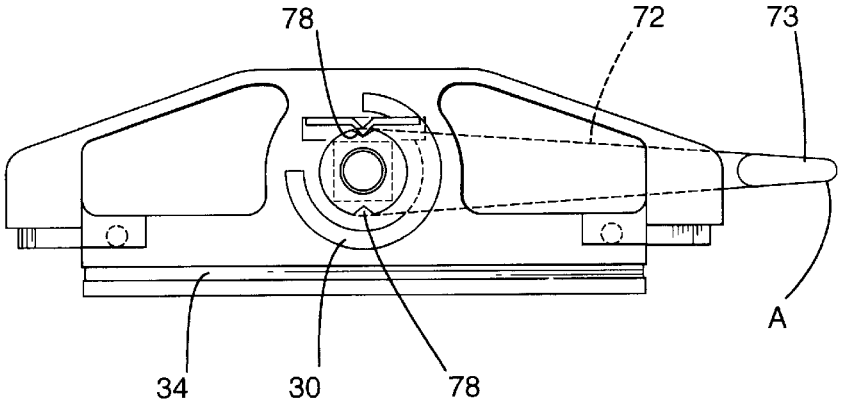
FIG. 5 is an elevational view of the assembly, partially in cutaway, to show the operation thereof.
Figure 6:
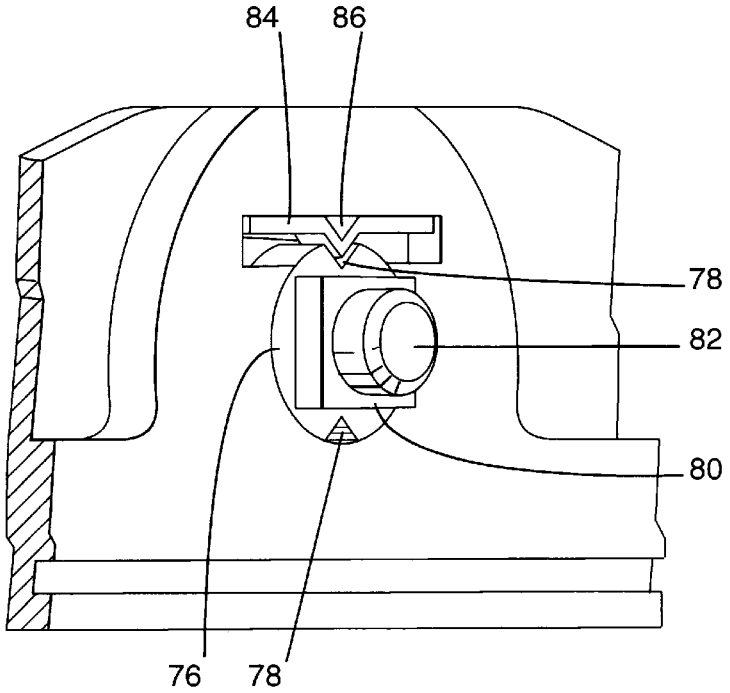
FIG. 6 is a detailed perspective view showing the operation of the locking mechanism of the window opening and closing assembly of FIG. 1.

Handle 18, as may be best seen in FIG. 1, has an arm 72 having at one end thereof a gripping portion 73. At the other end there is provided a shaft portion 74 which includes a first circular segment 76. Located within first circular segment 76 are a pair of notches 78 (FIGS. 5 and 6). Extending outwardly from first circular segment 76 is a square segment 80 sized to fit within square aperture 66 of pinon 16. Extending outwardly from square segment 80 is a second circular segment 82.

As may be best seen in FIG. 6, a spring member 84 having a v-shaped protrusion 86 is mounted within upper slot recess 48 of front wall 36.

The window opening and closing device, as previously mentioned, is preferably formed of suitable molded plastic material. For assembly, rack 54 is placed between first half housing 10 and second half housing 12 with flanges 60 engaged in lower slot recess 50 of front wall 36 and slot recess 34 of back wall 22. Rack 14 is thus slidable in the longitudinal direction with respect to first half housing member 10 and second half housing member 12. Pinon 16 is mounted to be in operative relationship to rack 14 with teeth 68 of pinon 16 engaging teeth 66 of rack 14.

In turn, handle 18 is placed through center aperture 46 in front wall 36. Square segment 80 is placed within aperture 66 to engage pinon 16 while second circular segment 82 fits within central aperture 32 of back wall 22. In turn, there may be provided a second handle segment (not shown) which engages second circular segment 82 and connects with handle 18.

The device is assembled with first half housing member 10 and second half housing member 12 secured together by means of locking pins 44 which fit within recesses 33 formed in back wall 22.

In operation, the window opening and closing assembly may be "locked" in either a fully closed or fully open position by means of V-shaped protrusion 86 of spring member 84 engaging one of the notches 78 formed in first circular segment 76.

Figure 7:
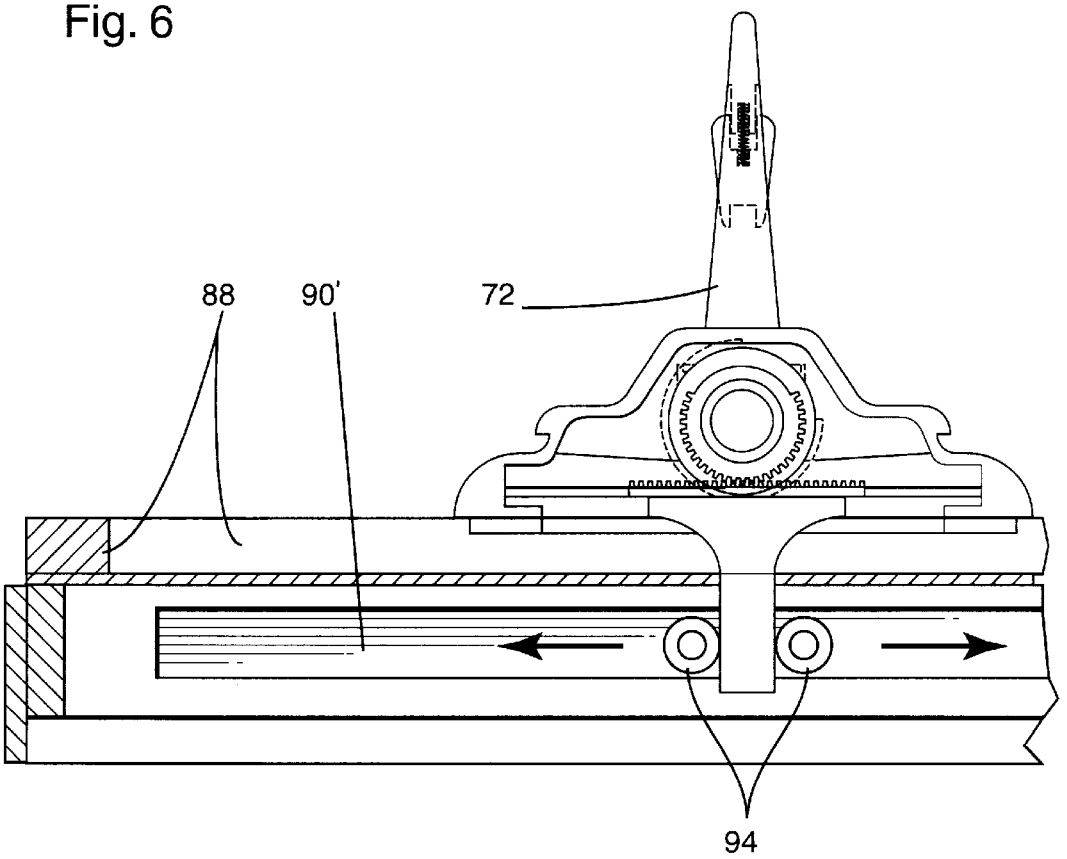
FIG. 7 is a view illustrating installation and operation of the window opening and closing assembly of FIG. 1.

As shown in FIG. 7, the device may be mounted on a suitable window frame generally designated by reference numeral 88. A channel 90 is provided in a conventional manner with tongue 58 engaging rollers 94.

Figure 8:
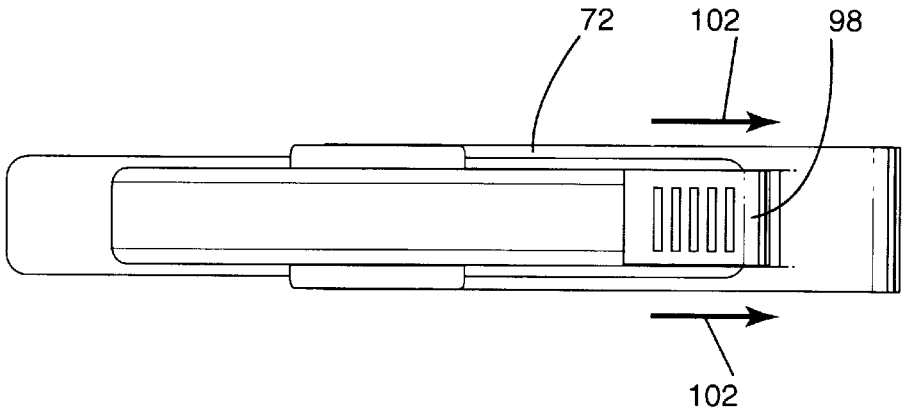
FIG. 8 is a top plan view of a slightly modified mechanism for the window opening and closing assembly.
Figure 9:
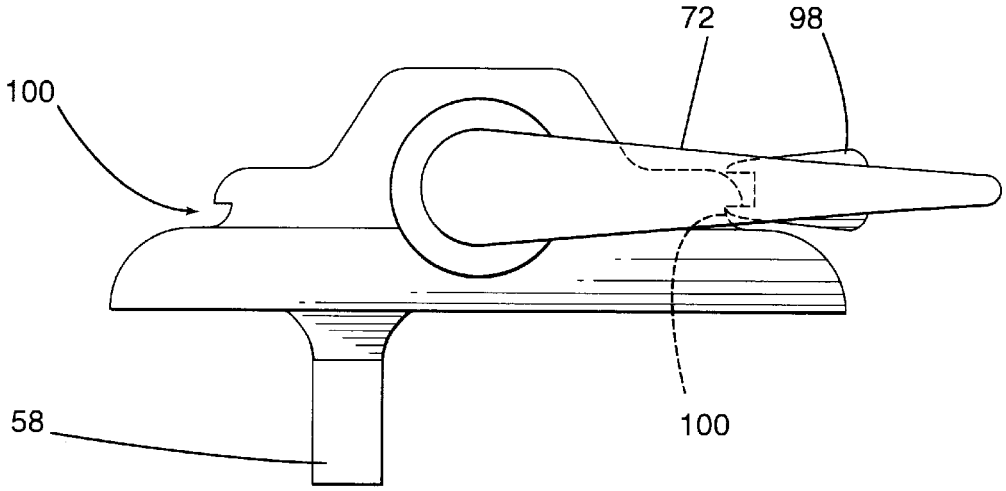
FIG. 9 is a side elevational view thereof.

In an alternative embodiment shown in FIGS. 8 and 9, the locking of the window opening and closing assembly may be achieved by use of a clip 98 which is mounted in the handle and is spring biased. The spring biases the locking clip 98 inwardly and clip 98 is formed to engage an undercut recess 100 formed on the housing. When it is desired to operate the window opening and closing device, the clip may be retracted as shown by arrows 102 and the handle may then be moved.

It will be understood that the above described embodiments are for purposes of illustration only and that changes and modifications may be made thereto without departing from the spirit and scope of the invention.

I claim:

1. A window opening and closing assembly comprising:

a housing;

a rack gear slidably mounted in said housing, said rack gear being moveable between first and second positions, said rack gear having gear teeth formed on one side thereof;

said rack gear having a tongue extending exteriorly of said housing, said tongue extending from a side of said rack gear opposite to said one side having said gear teeth;

a pinon gear operatively engaged with said rack gear; and a handle having a handle shaft connected to said pinon gear whereby rotatable movement of said handle shaft will cause said pinon to move said rack gear within said housing between said first and second positions.

2. The window opening and closing assembly of claim 1 wherein said housing comprises first and second housing members secured together, each of said housing members having a groove formed on an interiorly facing wall thereof, said rack having a flange extending outwardly on each side thereof, said flanges being slidably engaged in said grooves.

3. The window opening and closing assembly of claim 1 further including means for locking said handle in a desired position.

4. The window opening and closing assembly of claim 3 wherein said housing, said rack gear, said pinon and said handle are formed of molded plastic.

5. The window opening and closing assembly of claim 3 wherein said means for locking said handle in a desired position comprises first and second notches formed on said handle shaft, a spring member mounted within said housing and having a protrusion extending therefrom, said spring member being mounted such that said protrusion will engage one of said first and second notches when said rack is in one of said first and second positions respectively to thereby lock said handle in an open or closed position.

6. The opening and closing assembly of claim 3 wherein said means for locking said handle in a desired position comprises a clip member mounted on said handle, said clip member being resiliently biased, said clip member being designed to engage said housing when said rack is in either of said first and second positions.

7. In combination, a window having a window frame, a window mounted in said window frame, and a window opening and closing assembly, said window opening and closing assembly comprising:

a housing mounted on said window frame;

a rack gear slidably mounted in said housing, said rack gear being moveable between first and second positions, said rack gear having gear teeth formed on one side thereof, said rack gear having a tongue extending exteriorly of said housing, said tongue extending from a side of said rack gear opposite to said one side having said gear teeth;

a pinon operatively engaged with said slidable rack; and a handle having a handle shaft connected to said pinon gear whereby rotatable movement of said handle shaft will cause said pinon to move said rack within said housing between said first and second positions.

8. The combination of claim 7 wherein said housing comprises first and second housing members secured together, each of said housing members having a groove formed on an interiorly facing wall thereof, said rack having a flange extending outwardly on each side thereof, said flanges being slidably engaged in said groove.

9. The combination of claim 7 further including a track mounted on said window frame, at least first and second rollers moveable within said track and operatively connected to open and close said window wherein said tongue engages rollers of said window to move said window between open and closed positions.

10. A window opening and closing assembly comprising:

a housing;

a rack gear slidably mounted in said housing, said rack gear being moveable between first and second positions, said rack gear having gear teeth formed on one side thereof, said rack gear having a tongue extending exteriorly of said housing, said tongue extending from a side of said rack gear opposite to said one side having said gear teeth;

a gear wheel operatively engaged with said rack gear, said gear wheel having teeth formed on an outer circumferential surface thereof;

a handle having a handle shaft connected to said gear wheel whereby rotatable movement of said handle shaft will cause said gear wheel to move said rack gear within said housing between said first and second positions, said handle extending substantially perpendicular to said handle shaft such that movement of said handle in a plane perpendicular to a longitudinal axis of said handle shaft will cause rotation of said handle shaft and said gear wheel.

11. The window opening and closing assembly of claim 10 wherein said gear wheel has a guide member extending outwardly therefrom, said guide member sitting within a recess formed in said housing to limit movement of said gear wheel through a predetermined radius.

* * * * *